US006416407B1

(12) United States Patent
Carrico et al.

(10) Patent No.: US 6,416,407 B1
(45) Date of Patent: Jul. 9, 2002

(54) MULTI-DRAW POKER

(76) Inventors: Travis Carrico, 1700 N. Green Valley, #3724 Henderson, NV (US) 89014; Mark Bryant, 3241 Ventana Hills, Las Vegas, NV (US) 89117; Robert Wilson, Jr., 4315 Boulder Hwy., Las Vegas, NV (US) 89121

( * ) Notice: Subject to any disclaimer, the term of this patent is extended or adjusted under 35 U.S.C. 154(b) by 0 days.

(21) Appl. No.: 09/193,257

(22) Filed: Nov. 16, 1998

(51) Int. Cl.[7] ..... A63F 9/24
(52) U.S. Cl. ..... 463/13; 273/292
(58) Field of Search ..... 463/13, 20; 273/292, 273/293, 303, 143 R

(56) References Cited

U.S. PATENT DOCUMENTS 4,743,022 A * 5/1988 Wood ..... 273/85 CP
5,042,818 A * 8/1991 Weingardt ..... 273/292
5,255,915 A * 10/1993 Miller ..... 273/85 CP
5,437,451 A 8/1995 Fulton

OTHER PUBLICATIONS

Scarne, john. Scarne's Encyclopedia of Card Games, 1983, Harper & Row, Publishers: New York. p. 14–15, 31.*

Description of Maniac poker Videotronics, Inc. Autor, Title, Date, Publisher unknown.

* cited by examiner

*Primary Examiner*—Joe H. Cheng
*Assistant Examiner*—Julia Brochetti
(74) *Attorney, Agent, or Firm*—Gene R. Woodle

(57) ABSTRACT

Embodiments of a multi-draw poker are disclosed which is played in a manner somewhat similar to traditional five card draw poker, but in which a player is given the opportunity to make additional wagers and additional draws.

12 Claims, 2 Drawing Sheets

MULTI-DRAW POKER

BACKGROUND OF THE INVENTION

1. Field of the Invention

This invention relates generally to a method for playing a casino card game, and more particularly to a poker-type game that may be played either as a table game or a computer video game.

2. Background Information

For hundreds of years a variety of card games has been played throughout the world for entertainment as well as wagering. In many countries, particularly the United States, legalized gambling has lead to a proliferation of casinos in which players may wager upon a number of card games. In most cases, the casino acts like the "banker" and the players bet against the casino rather than betting against each other. Casino games employing traditional cards and dealers are often referred to as table games. In recent years video or computer card games have become very popular. In these games, electronic circuits and computer chips take the place of dealers; and images of cards upon video screens replace traditional cards.

The most popular of casino table and video games include traditional five card stud poker and five card draw poker and variations of those games. In most poker-type games, hands which may be achieved are ranked according to the difficulty of achieving the hands with higher payouts being made for the hands more difficult to achieve. In most cases hands are ranked as follows: one pair, two pairs, three of a kind, straight, flush, full house, four of a kind, straight flush, and royal flush. In most casino games one pair receives the smallest return or payout and a royal flush receives the highest return or payout based upon a predetermined payout table.

Although there are a number of variations; in five card draw poker, a player makes a wager and is dealt five cards. The player then has the option of discarding from 0 to 5 cards and being dealt an equal number of replacement cards in an attempt to improve his hand. If the player elects to draw 0 cards or "stand pat" he receives a payout based upon the rank of the hand and the payout table. If the player draws cards and receives a winning hand based upon the cards held from the original hand and the replacement cards, he receives a payout based upon the rank of the hand and the payout table. If the player does not achieve a winning hand (often a hand having a rank of less than one pair of jacks), the player receives no payout and looses his original wager.

In traditional stud poker, a player is dealt five cards and the rank of hands is the same as the rank in draw poker; but the player is not entitled to discard or draw additional cards in an attempt to improve his hand.

Because of the nature of gambling, casinos and others are constantly searching for poker games which are interesting, exciting, and fun and easy to play. In addition, games which encourage higher wagers or more wagers are also considered desirable.

A number of casino games including both table and video games have been patented or introduced which are believed to be more interesting and fun to play than traditional stud or draw poker.

A stud poker game in which an element of drawing is introduced is disclosed in the patent to Fulton (U.S. Pat. No. 5,437,451; Aug. 1, 1995). The rank of hands, cards, etc. are the same as in conventional stud poker; but the card drawing method is different. Four cards are dealt and the player has the option of accepting the fourth card dealt or refusing it. If the card is refused, a random card is dealt to the player. A fifth card is dealt and the player also has the option of accepting or refusing that card. If the card is refused a random fifth card is dealt. Depending upon the rank of the hand achieved, a payout is made if a winning hand is achieved based upon a predetermined payout table.

A variation of traditional five card draw poker is disclosed in the patent to Miller (U.S. Pat. No. 5,255,915; Oct. 26, 1993). This game is very similar to standard five card draw poker, but is played with six cards rather than five. The player makes a wager and is dealt six cards. The player then has a choice of cashing out if dealt a winning hand, according to a predetermined payout table, or drawing up to six new cards. All six cards may be used in a hand; for example, three pairs is a winning hand. The player either gets a -winning hand and is paid or the game ends. The unique aspect of this game is a number of six card hands not possible in a five card game.

Another variation on draw poker is disclosed in the patent to Wood (U.S. Pat. No. 4,743,022; May 10, 1988). In this game the player makes a wager and receives five cards. The player can discard up to five cards and have replacements dealt. The player looses if the hand has no pair, gets his wager back if the first hand had a pair, and receives, if the first hand had a higher ranking, an increase amount according to predetermined odds. The player can then make second wager and receive a sixth card, provided that by receiving the correct card the player could achieve a straight or higher and a hand having a higher rank than the previous hand. The player wins if the last hand is a straight or higher and higher than the previous hand.

The multi-draw poker game of the instant invention is believed to be interesting, exciting, and fun and easy to play. In addition, the instant invention encourages high wagers and multiple wagers which is thought to add to a player's excitement and entertainment.

The instant invention is a multi-draw poker game which is unique, original, and fills the need for new and improved methods of playing casino table or video games. The multi-draw poker of the instant invention provides for excitement, entertainment, and wagering which is unknown in the prior art.

The ideal casino table or video poker game is interesting, exciting, and fun to play. The ideal casino table or video poker game should also be easy to understand and learn to play. The ideal casino table or video poker game should also be unique and original to stimulate play. The ideal casino table or video poker game should also provide for multiple wagers or higher wagers.

SUMMARY OF THE INVENTION

The multi-draw poker game of the instant invention is a variation of draw poker which may be played either as a casino table game or as a video or computer game. The game is played with a single, conventional 52 card deck or with a computer simulation of such a deck. Basic rules are similar to traditional five card draw poker and hands are ranked traditionally as described above.

The player makes a wager and is dealt five cards. The player then makes a decision to hold from 0 to 5 cards. If the player determines to hold all 5 cards (to stand pat), the resulting poker hand is compared to a predetermined payout table. If the hand is a winning hand, the player is paid based upon the payout table. If the hand is not a winning hand, the player is notified that a winning hand has not been achieved and directed to discard from 1 to 5 cards.

If the player holds from 0 to 4 cards, the discarded cards are replaced with an equal number of new cards and a new five card hand is created. The new hand is then compared to the predetermined payout table. If the new hand is not a winning hand, the player has the option of halting the game or holding from 0 to 4 cards and continuing play. If the player elects to continue play, the play continues as described below, continuing as if the player had a winning hand and elected to hold from 0 to 4 cards. If the new hand is a winning hand, the player again makes a decision to hold from 0 to 5 cards. If the player elects to hold all 5 cards, the resulting poker hand is compared to the predetermined payout table, the player is paid based upon the payout table, and the game ends. If the player elects to hold from 0 to 4 cards, a second wager must be made equal to the amount which would have been won had the player elected to hold all 5 cards plus an amount equal to or greater than the original wager. The discarded cards are replaced with an equal number of new cards and a new five card hand is created. The new hand is compared to a second payout table and, if the new hand is a winning hand, the player is paid according to the second payout table. If the new hand is not a winning hand, the player loses both the original wager and the second wager.

Although the game is described above a being played with five cards, it could also be played with varying numbers of cards, using different payout tables, and with a stock of cards other than a traditional 52 card deck. The game is described above as being played with two draws, but the game could be played with additional draws and additional payout tables until the 52 card deck was exhausted.

One of the major objects of the present invention is to provide a multi-draw poker game which is interesting, exciting, and fun to play.

Another objective of the present invention is to provide a multi-draw poker game which is easy to understand and learn to play.

Another objective of the present invention is to provide a multi-draw poker game which is unique and original to stimulate play.

Another objective of the present invention is to create a multi-draw poker game which also provides for multiple wagers and higher wagers.

These and other features of the invention will become apparent when taken in consideration with the following detailed description and the drawings.

DESCRIPTION OF A PREFERRED EMBODIMENT

Figure 1:
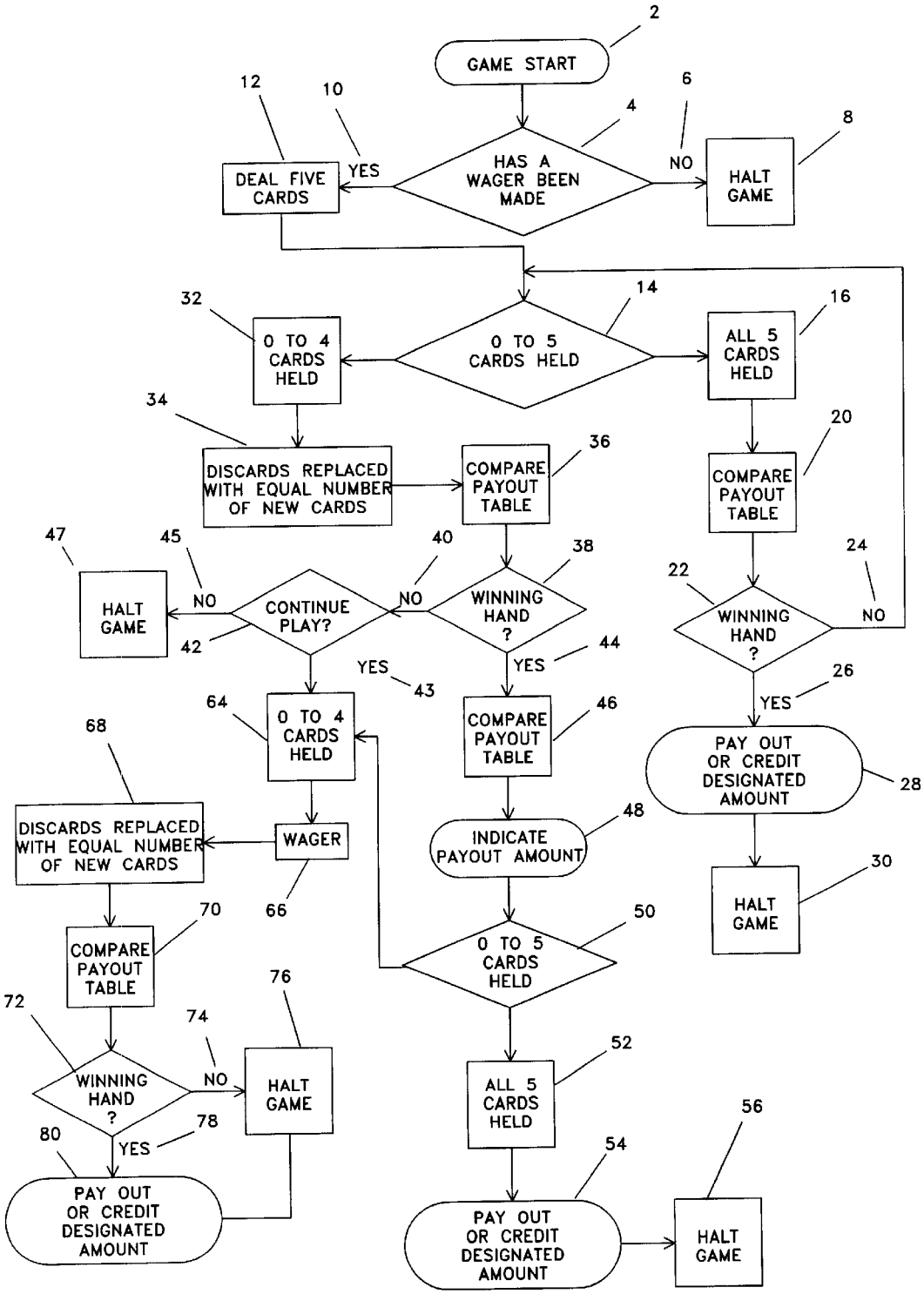
FIG. 1 is a flow chart schematically illustrating the steps in the operation of a single hand of the multi-draw poker game of the instant invention.

Referring to the drawing FIG. 1, there is shown a schematic illustration of a preferred form of multi-draw poker embodying the present invention.

Multi-draw poker of the present invention is a variation of traditional draw poker with many unique and original variations and modifications of the traditional game. Multi-draw poker is played with a conventional 52 card deck of cards either manipulated by a dealer or by a computer driven video gaming machine. No wild cards or jokers are employed and winning hands are those traditionally recognized in poker ranked from lowest to highest as: one pair jacks or better), two pair, three of a kind, straight, flush, full house, four of a kind, straight flush, royal flush. For purposes of this game, a royal flush is considered to be the ten, jack, queen, king, and ace of a particular suit.

In either of its major embodiments, the computer video game version or the dealer generated version, the play of the multi-draw poker game of the instant invention may be readily understood from the flow chart of the drawing.

In the computer video game version of the multi-draw poker game of the instant invention, the flow chart represents the actions of a computer program embodying the game procedure and its interaction with the player. At 2 the player starts the game, either by making a wager, by pushing a button, by touching an on-screen touch sensor, or by otherwise electronically or mechanically signaling to the computer to initiate the program. The player makes a wager by the deposit of a coin or coins, or token or tokens, or currency, or by signaling the use of previously accumulated credits from prior winnings. The computer at 4 determines whether or not a wager has been registered by the player. If no wager has been made, the computer by way of 6 will halt the game at 8. Preferably, however, the program will provide an on-screen prompt to the player reminding the player that a wager is required. If a wager is not forthcoming within a predetermined time period, the program then proceeds to halt the game at 8.

Once a wager has been recorded by way of 10, the program deals five cards to the player in the form of representations of card faces appearing on the video screen. The method of determining the cards to be dealt is normally by means of random number generation within the computer program, where each card in a single conventional 52 card deck is assigned a unique numerical designation within the program. The output of the random number function within the program is then compared with the table of card designations within the program, the card having that specific numerical designation identified, and the card representation of that card displayed on the screen. Once the random number function has selected the representation of a particular card, a blocking function prevents that same card from being selected a second time in the same hand. That is, when the random number function generates a number which is not identified with any card in the card identification table or when it generates a number for a card which has already been represented on the screen during that hand, the random number function is automatically reset and continues to generate numbers through repeated iteration until a number representing an unused card is generated and that card is then represented on the screen at 12. Because of the speed of the system, the entire five card hand appears to the player at 12 to have been dealt simultaneously or in rapid succession.

Once the five card hand has been dealt at 12 the player is given the opportunity at 14 to examine the hand and determined whether or not to play the hand as is or to discard from 0 to 5 cards. If the player has a winning hand in the first five cards dealt, the player has the option of standing pat and playing the winning five card hand or discarding I or more cards in an attempt to obtain a higher ranking hand. If the player is satisfied with the value of the first hand and elects to play that first hand as shown (by standing pat), he or she signals the computer that all five cards are to be held at 16 either by pushing a designated button, on-screen touch sensor, or by another appropriate method. The program then compares the hand to the first predetermined payout table (a typical first predetermined payout table is displayed below) at 20. The program determines at 22 whether the hand is a winning hand. If the hand is not a winning hand at 24 the program generates an on-screen notice that a winning hand was not obtained and the player is directed to discard 0 to 5 cards at 14. In another embodiment, if a winning hand was not obtained at 24, the game may then also be halted. If a winning hand was obtained at 26, the appropriate payout is determined from the first predetermined payout table and the player either receives the payout or is credited with the payout amount at 28. The game is then halted at 30.

If the player at 14 chooses not to stand pat as described above, the player indicates at 32 which of the original five cards are to be held or which of the original five cards are to be discarded. The player may choose to hold from 0 to 4 of the original cards. At 34 the program will replace the cards discarded with an equal number of replacement cards to create a second five card hand. Replacement cards are dealt using the random number function described above with blocking to prevent regeneration of representations of cards already dealt.

The second hand created at 34 is then compared by the program with the first predetermined payout table at 36. The program determines at 38 whether the second hand is a winning hand. If the second hand is not a winning hand at 40, the player is given the option at 42 to halt play or to continue play. If the player chooses to halt play at 45 the game is halted at 47. If the player chooses to continue play at 43, the player elects to hold from 0 to 4 cards at 64. Play beyond 64 is as described below.

If the second hand is a winning hand at 44, the program compares the hand to the first predetermined payout table at 46 and indicates the amount of the projected payout on-screen at 48. The player is again given the opportunity at 50 to examine the hand and determine whether to hold from 0 to 5 cards in the second hand. If the player chooses to hold all five cards or stand pat at 52, the appropriate payout is determined from the first predetermined payout table and the player either receives the payout or is credited with the payout amount at 54. The game is then halted at 56.

If the player at 50 chooses not to stand pat as described above, the player indicates at 64 which of the original five cards in the second hand are to be held or which of the original five cards in the second hand are to be discarded. (From this point onward, the play is the same for a player electing to continue play at 43.) The player may choose to hold from 0 to 4 of the original cards in the second hand. At this point, in order to continue play, the player must make an additional wager at 66. The additional wager at 66 is equal to or greater than the amount of the original wager at 4 plus the amount of the credit or payout which would have been received for the hand as determined and displayed at 48. At 68 the program will replace the cards discarded with an equal number of replacement cards to create a third five card hand. Replacement cards are dealt using the random number function described above with blocking to prevent regeneration of representations of cards already dealt.

The third hand created at 68 is then compared by the program with a second predetermined payout table (a typical second predetermined payout table is displayed below) at 70. The program determines at 72 whether the third hand is a winning hand. If the third hand is not a winning hand at 74, the game is halted at 76 with no payout or credit to the player. If the third hand is a winning hand at 78, the appropriate payout is determined from the second predetermined payout table and the player either receives the payout or is credited with the payout amount at 80. The game is then halted at 76. The player is induced to give up the winning hand and potential payout from that winning hand obtained at 38 and to make the additional wager required at 66, by a number of increased payouts in the second predetermined payout table as opposed to the payouts in the first predetermined payout table. For example, as indicated in the typical predetermined payout tables set out below, with one coin bet, four aces would result in a payout of 25 coins under the first predetermined payout table; but under the second predetermined payout table, four aces would result in a payout of 160 coins.

The predetermined payout tables are initially constructed in the computer's memory before the apparatus is put into use. The tables remain unchanged throughout the life of the apparatus, unless the owner of the apparatus decides to alter the payouts or a regulatory agency sets different requirements for payouts. The players cannot alter the payout tables by their method of play. The payout tables will identify all possible winning combinations or hands and the appropriate payout amount for each hand, based primarily on the probability of that combination occurring. Payout tables are commonly displayed on the screen or on a glass or panel of the game apparatus, so that the player is aware of the reward he or she is playing for. Typical first and second predetermined payout tables are shown below.

Typical First Payout Table

| | 1st Coin | 2nd Coin | 3rd Coin | 4th Coin | 5th Coin |
|---|---|---|---|---|---|
| Royal Flush | 250 | 500 | 750 | 1,000 | 4,000 |
| Straight Flush | 50 | 100 | 150 | 200 | 250 |
| 4 of a Kind | 25 | 50 | 75 | 100 | 125 |
| Full House | 7 | 14 | 21 | 28 | 35 |
| Flush | 5 | 10 | 15 | 20 | 25 |
| Straight | 4 | 8 | 12 | 16 | 20 |
| 3 of a Kind | 3 | 6 | 9 | 12 | 15 |
| 2 Pair | 2 | 4 | 6 | 8 | 10 |
| Jacks or Better | 1 | 2 | 3 | 4 | 5 |

Typical Second Payout Table

| | 1st Coin | 2nd Coins | 3rd Coin | 4th Coin | 5th Coin |
|---|---|---|---|---|---|
| Royal Flush | 250 | 500 | 750 | 1,000 | 4,000 |
| Straight Flush | 50 | 100 | 150 | 200 | 250 |
| 4 Aces w/ 2, 3, or 4 | 400 | 800 | 1,200 | 1,600 | 2,000 |
| 4 Aces | 160 | 320 | 480 | 640 | 800 |
| 4 2's, 3's or 4's w/ Ace, 2, 3, 4 | 160 | 320 | 480 | 640 | 800 |
| 4 2's, 3's or 4's | 80 | 160 | 240 | 320 | 400 |
| 4 5's thru K's | 50 | 100 | 150 | 200 | 250 |
| Full House | 8 | 16 | 24 | 32 | 40 |
| Flush | 5 | 10 | 15 | 20 | 25 |
| Straight | 4 | 8 | 12 | 16 | 20 |
| 3 of a Kind | 3 | 6 | 9 | 12 | 15 |
| 2 pair | 1 | 2 | 3 | 4 | 5 |
| Jacks or Better | 1 | 2 | 3 | 4 | 5 |

The two predetermined payout tables are geared to common gambling procedures which typically allow a player to make wagers of a single coin or betting unit or multiples of the betting unit up to a set maximum. In the case of the two typical predetermined payout tables the maximum bet is set at 5 betting units. In the preferred, described embodiment, the maximum bet is set at 5 betting units; however, in other embodiments, the maximum wager could be any number of betting units. Players are typically given an incentive to make larger bets by sometimes increasing the relative payout for a maximum bet. For example, in the first Table above, the player receives a significantly higher return on a bet of five coins over a bet of four coins for obtaining a royal flush. As is shown in the second Table above, a player receives a higher reward for obtaining four aces with a 2, 3, or 4 than for four aces coupled with other cards. This fosters excitement as well as a belief in the player that the strategy of the player is important.

The predetermined payout tables shown above are only intended to portray possible typical payout tables and other payout tables with different payouts and different winning hands could be employed.

The first major embodiment of multi-draw poker of the instant invention is described above as being played using a computer operated video gambling apparatus. In a second major embodiment, the multi-draw poker game of the instant invention could be played with a human dealer rather than the computer operated video gambling apparatus. In the game with the dealer, the computer generated card representations would be replaced with actual cards from a conventional 52 card deck shuffled and dealt by the dealer. The game would be played in the manner described above, but the dealer would make decisions, notifications, and comparisons described above as being made by the computer program. In another embodiment of this dealer operated game, the multi-draw poker game of the instant invention could be played with a stock of cards based upon a conventional 52 card deck; but having more than 52 cards or having different numbers of various cards from the 52 card deck.

Although the preferred embodiment of the multi-draw poker game of the instant invention described above allows for two draws at 34 and at 68, the game in other embodiments could allow for continued additional wagers as at 66 and additional draws as at 68 until all of the remaining stock of cards in the deck had been dealt. This allows an additional predetermined payout table which would be used for each additional draw. The multi-draw poker game of the instant invention is described above as being played with hands consisting of five cards, but other embodiments could be produced which would use different numbers of cards for hands provided that different predetermined payout table were used and different ranking of winning hands provided.

Although the embodiments described above indicate that players make monetary wagers and are rewarded monetarily, the multi-draw poker game of the instant invention could also be played for entertainment purposes only. In such cases the payout would be in the form of points accumulated, prizes, or other awards. In such games the computer program may retain and add up points scored for a particular playing session and to display the points achieved as well as to retain and display the highest previously achieved scores.

In actual play conditions, credits represent points achieved or money won and it is desirable to let such credits accumulate and be displayed on the screen, and to have means by which the player can designate wagers of either points of money won from such accumulated credits. This often allows the player to measurably increase the number of games played in a given period of time, because the player need not stop to insert additional coins, tokens, or currency between each play. If points achieved or money won is tracked in this manner, the actual monetary payout would not come until the player indicates, through pushing a designated button or touching a designated touch panel or signaling in some other manner, that he or she is finished with the present play sequence and wishes to be paid the accumulated credited winnings.

In locations where gambling is permitted, the payout will be in the form of coins or tokens or other means representing the value returned for each equivalent token or coin initially played at the time of the wager. The apparatus of the game will also include appropriate conventional mechanical means to accumulate and dispense some or all of the coins or tokens awarded for each winning hand, either at the time the winning hand is obtained or at the time that the player indicates a desire for payment of the accumulated winnings.

If, as described above, the multi-draw game of the instant invention is played with a dealer rather than a computer video gaming apparatus, all betting and payouts would be handled by the dealer. Because a traditional 52 card deck would not include sufficient cards for a dealer operated game to be played with multiple players, a deck based upon a 52 card deck, but having more cards, multiple decks, different cards (including jokers, wild cards etc.), or having different numbers of various cards could be used.

Figure 2:
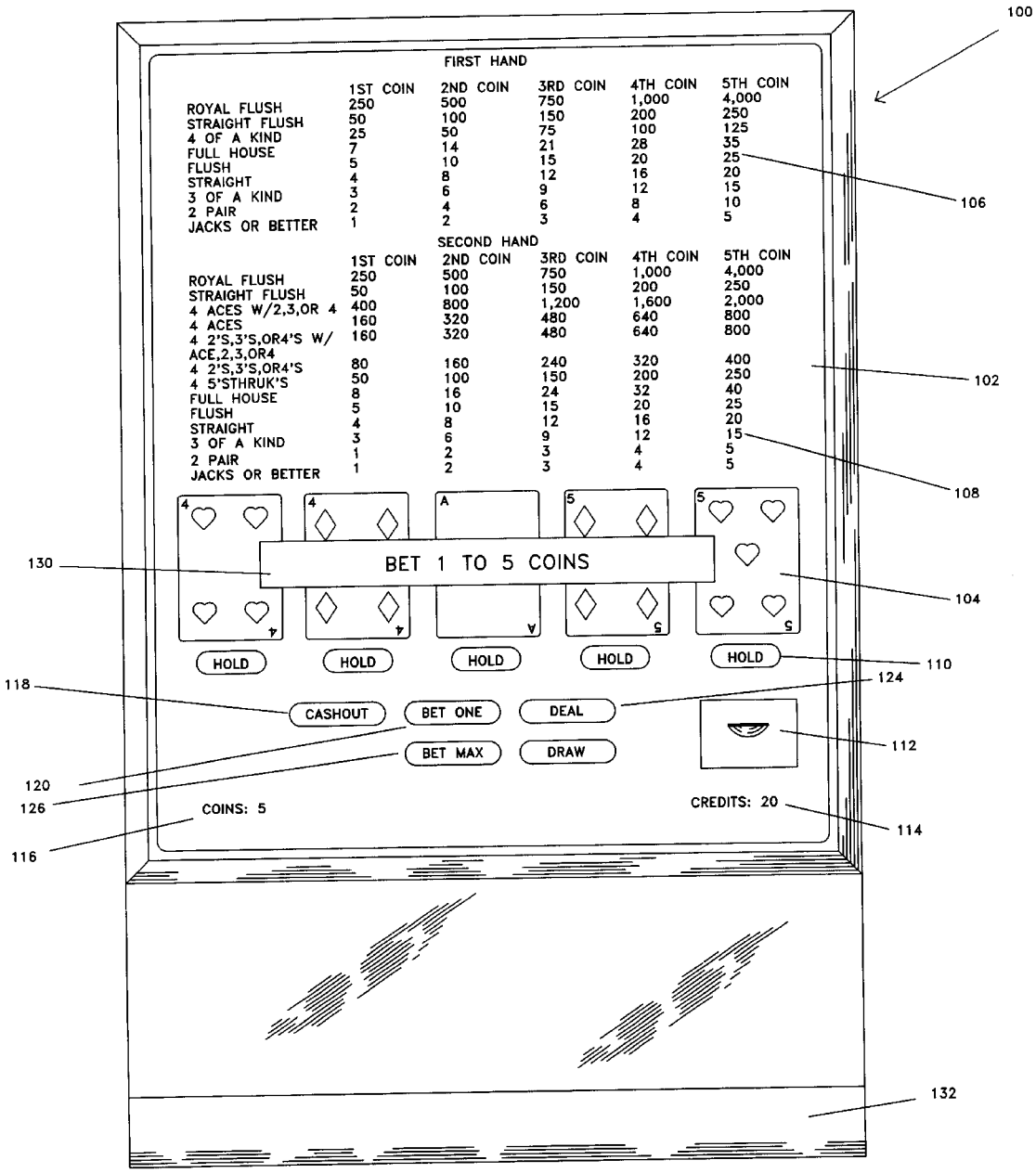
FIG. 2 shows a video gaming machine of the type upon which the video gaming embodiment of the multi-draw poker game of the instant invention may be played.

Now referring to FIG. 2, a video gaming machine 100 of the type upon which the video gaming embodiment of the multiple draw poker game of the instant invention is shown. Video gaming machines of this type are well known in the prior art and the various computer chips, circuits, sensors, and displays necessary to implementation of the multiple draw poker game of the instant invention are within the capability of a person reasonably well versed in the prior art. A video display screen 102 the various visual displays necessary to play multiple draw poker. A player's current hand 104 is displayed as representations of the cards which make up the hand. A first typical payout table 106 is displayed at the top of the video display screen 102. A second typical payout table 108 is displayed between the first typical payout table 106 and the player's current hand 104. A hold control button 110 is provided for each of the cards in said player's current hand 104. A coin entry 112 is provided to accept coins or tokens from the player.

Still referring to FIG. 2, a credits indicator 114 is provided which indicates the number of credits the player has from coins or tokens played or previous winning hands. A bet display 116 displays the amount the player has currently bet. In addition to the hold control buttons 110, other control buttons including a cashout button 118, a bet one button 120, a bet max button 122, a deal button 124, and a draw button 126 are also provided. The cashout button 118 is used by the player to cashout any credits which may have accumulated. The bet one button 120 allows the player to bet one betting unit and multiples of one betting unit by pushing said bet one button multiple times. The max bet button 118 allows the player to bet the maximum bet, five units in the preferred embodiment. The deal button 124 is used by the player to indicate that a new hand should be dealt. The draw button 126 is used by the player to indicate that all of the desired cards have been marked by said hold control buttons 118 and that replacement cards should be dealt. In the preferred embodiment, the credits indicator 114 and the bet display 116 are LED displays, but other display methods could be used. In the preferred embodiment the control buttons are touch sensors, but other methods including mechanical buttons could be used.

A message bar 130 is also provided on said video display screen 102. The message bar 130 is not displayed continuously, but is superimposed over said player's current hand 104 when needed. Said message bar is used to display a variety of messages to the player when necessary to give directions or instructions or to provide other desired messages. A coin tray 132 is provided at the base of the electronic video gaming machine 100 to collect and dispense coins or tokens when a payout is made to the player.

Said electronic video gaming machine 100 is activated by the player placing one or more coins or tokens into the coin entry 112 or by the player making a bet using said bet one button 120 or said bet max button 122. In the preferred embodiment, the player's first hand is dealt automatically upon pressing of said bet max button 122, but the player must press said deal button 124 to initiate the first deal if coins or tokens are placed in said coin entry 112 or if the player uses said bet one button 120. After the game has been initiated, the player indicates which cards are to be held using said hold buttons 106 and any cards not so held are replaced with new cards in the display of said player's current hand 104. The play continues as previously described with necessary instructions being displayed in said message bar 130 and with the player indicating decisions and instructions for said electronic video gaming machine 100 using the various control buttons.

While preferred embodiments of this invention have been shown and described above, it will be apparent to those skilled in the art that various modifications may be made in these embodiments without departing from the spirit of the present invention. For that reason, the scope of the invention is set forth in the following claims:

We claim:

1. A method of playing a multi-draw poker-like game in which a winning hand generates a payout to a player using a computer and a video screen which comprises:

(1) providing a first payout table defining a predetermined set of winning hands of different ranks and payout values selected from a single deck of cards, each card having a different face value and suit, and with the remaining hands from said deck not included within the predetermined set of winning hands not having any payout value;

(2) providing a second payout table defining a predetermined set of winning hands of different ranks and payout values selected from a single deck of cards, each card having a different face value and suit, with the second payout table having at least one payout value different from the payout value established in said first payout table, and with the remaining hands from said deck not included within said predetermined set of winning hands not having any payout value;

(3) registering a wager with the computer;

(4) generating and displaying on the video screen a visual representation of a first hand of five cards randomly selected from the single deck of cards;

(5) determining the rank the first hand with respect to the first payout table from the face value and suit of each represented card;

(6) enabling said player to terminate the game or to designate at least one of said represented cards for replacement;

(7) if said designation is registered, in response thereto replacing at least one designated card in said first hand with a corresponding number of other represented cards randomly generated from the remaining cards in said single deck and displayed on said video screen, the unreplaced cards from said first hand and said replacement cards forming a second hand of five cards, with said second hand replacing said first hand;

(8) determining the rank of said second hand with respect to said first payout table from the face value and suit of each represented card;

(9) giving said player the option of either terminating play and being paid according to said first payout table or of making an additional wager and continuing play;

(10) if said player chooses the option of making an additional wager and continuing play, enabling said player to designate at least one of said represented cards of said second hand for replacement;

(11) if said designation of replacement of said represented cards of said second hand for replacement is registered, in response thereto replacing at least one designated card in said second hand with a corresponding number of other represented cards randomly generated from the remaining cards in said single deck and displayed on said video screen, the unreplaced cards from said second hand and said replacement cards forming a third hand of five cards, with said third hand replacing said second hand;

(12) determining the rank said third hand with respect to the second payout table from the face value and suit of each represented card and thereafter terminating said game; and

(13) upon termination after said first, second, or third hand providing said predetermined payout to said player according to the value of the remaining hand of cards as defined by said first payout table for said first or second hand and as defined by said second payout table for said third hand;

whereby a player may make a wager and play a poker game similar to five card draw poker, but in which the player may have the option to make an additional wager and make an additional draw of cards.

2. The multi-draw poker game of claim 1 in which a number of cards other than five are dealt.

3. The multi-draw poker game of claim 2 in which a player may make additional wagers and draws and additional hands are created until all 52 cards of the deck are used.

4. The multi-draw poker game of claim 1 in which a stock of cards other than a traditional 52 card deck is used.

5. The multi-draw poker game of claim 1 in which the player is given the opportunity to make an additional wager prior to the time said second hand is created.

6. The multi-draw poker game of claim 1 in which a player may make additional wagers and draws and additional hands are created until all 52 cards of the deck are used.

7. A method of playing a multi-draw poker-like game using a standard deck of playing cards which comprises:

(1) providing a first payout table defining a predetermined set of winning hands of different ranks and payout values selected from a single deck of cards, each card having a different face value and suit, and with the remaining hands from said deck not included within the predetermined set of winning hands not having any payout value;

(2) providing a second payout table defining a predetermined set of winning hands of different ranks and payout values selected from a single deck of cards, each card having a different face value and suit, with the second payout table having at least one payout value different from the payout value established in said first payout table, and with the remaining hands from said deck not included within said predetermined set of winning hands not having any payout value;

(3) making a wager by the player;

(4) dealing a first hand of five cards randomly selected from the single deck of cards;

(5) determining the rank the first hand with respect to the first payout table from the face value and suit of each represented card;

(6) enabling said player to terminate the game or to designate at least one of said cards for replacement;

(7) if said player makes such designation, in response thereto replacing at least one designated card in said first hand with a corresponding number of other cards randomly from the remaining cards in said single deck, the unreplaced cards from said first hand and said replacement cards forming a second hand of five cards, with said second hand replacing said first hand;

(8) determining the rank of said second hand with respect to said first payout table from the face value and suit of each represented card;

(9) giving said player the option of either terminating play and being paid according to said first payout table or of making an additional wager and continuing play;

(10) if said player chooses the option of making an additional wager and continuing play, enabling said player to designate at least one of said cards of said second hand for replacement;

(11) if said player makes such designation for of replacement of said cards of said second hand, in response thereto randomly replacing at least one designated card in said second hand with a corresponding number of other represented cards from the remaining cards in said single deck, the unreplaced cards from said second hand and said replacement cards forming a third hand of five cards, with said third hand replacing said second hand;

(12) determining the rank said third hand with respect to the second payout table from the face value and suit of each represented card and thereafter terminating said game; and

(13) upon termination after said first, second, or third hand providing said predetermined payout to said player according to the value of the remaining hand of cards as defined by said first payout table for said first or second hand and as defined by said second payout table for said third hand;

whereby a player may make a wager and play a poker game similar to five card draw poker, but in which the player may have the option to make an additional wager and make an additional draw of cards.

8. The multi-draw poker game of claim 7 in which a number of cards other than five are dealt.

9. The multi-draw poker game of claim 7 in which a player may make additional wagers and draws and additional hands are created until all 52 cards of the deck are used.

10. The multi-draw poker game of claim 8 in which a player may make additional wager and draws and additional hands are created until all 52 cards of the deck are used.

11. The multi-draw poker game of claim 7 in which a stock of cards other than a traditional 52 card deck is used.

12. The multi-draw poker game of claim 7 in which the player is given the opportunity to make an additional wager prior to the time said second hand is created.

* * * * *